US005485776A

United States Patent [19]

Ealovega

[11] Patent Number: 5,485,776

[45] Date of Patent: Jan. 23, 1996

[54] MECHANISM FOR CONTROLLING THE FIRING RATE OF AN AUTOMATIC WEAPON

[75] Inventor: George Ealovega, Haslemere, Great Britain

[73] Assignee: Bushman Limited, United Kingdom

[21] Appl. No.: 322,365

[22] Filed: Oct. 13, 1994

Related U.S. Application Data

[63] Continuation of Ser. No. 75,334, Jun. 11, 1993, abandoned, which is a continuation of Ser. No. 752,609, filed as PCT/GB90/01969, Dec. 17, 1990, abandoned.

[30] Foreign Application Priority Data

Dec. 16, 1989 [GB] United Kingdom ..... 8928452

[51] Int. Cl.[6] ..... F41A 19/04

[52] U.S. Cl. ..... 89/130; 89/135

[58] Field of Search ..... 89/7, 129.01, 130, 89/131, 133, 135, 149

[56] References Cited

U.S. PATENT DOCUMENTS

| | | | |
|---|---|---|---|
| 1,595,993 | 8/1926 | Cecero | 89/133 |
| 2,053,265 | 9/1936 | Coupland | 89/133 |
| 2,154,770 | 4/1939 | Petter | 89/130 |
| 2,382,352 | 8/1945 | Trevaskis | 89/135 |
| 2,448,024 | 8/1948 | Golden | 89/129.01 |
| 2,532,794 | 12/1950 | Teece | 89/131 |
| 2,791,942 | 5/1957 | Fletcher | 89/131 |
| 3,648,561 | 3/1972 | Stoner | 89/135 |
| 3,748,960 | 7/1973 | Mindel | 89/135 |
| 4,004,495 | 1/1977 | Belfer | 89/42.03 |
| 4,023,465 | 5/1977 | Inskip | 89/131 |
| 4,028,993 | 6/1977 | Reynolds | 89/130 |
| 4,062,266 | 12/1977 | Elmore et al. | 89/7 |
| 4,355,563 | 10/1982 | Swieskowski | 89/130 |
| 4,469,006 | 9/1984 | Teppa | 89/149 |

FOREIGN PATENT DOCUMENTS

| | | | |
|---|---|---|---|
| 902696 | 12/1985 | Belgium . | |
| 1055229 | 2/1954 | France | 89/129.01 |
| 635896 | 9/1936 | Germany . | |
| 1428774 | 1/1970 | Germany . | |
| 403580 | 1/1946 | Italy | 89/129.01 |
| 536995 | 6/1973 | Switzerland . | |

OTHER PUBLICATIONS

Webster's New World Dictionary, 1957, "Rifle", p. 1253.

*Primary Examiner*—Stephen C. Bentley
*Attorney, Agent, or Firm*—Banner & Allegretti, Ltd.

[57] ABSTRACT

A gun capable of fully automatic firing having a trigger mechanism comprising; an arrest mechanism operable to interrupt ammunition discharging mechanism, the arrest mechanism comprising a cam element which cooperates with a complementary cam element of a timing device, and wherein the timing device comprises an electric motor operable to drive the complementary cam element when a physically displaceable trigger of the trigger mechanism is moved to a firing position and when the gun is in a fully automatic mode of operation, the timing device being operable to effect cyclical release of the discharge mechanism by said arrest mechanism.

15 Claims, 8 Drawing Sheets

13
26
39
24
33
33a
41
41a
25
32
40
44
58
56
54
38
22
14
15
17
16
20
30
28
36
34
42
S
F
A 13
26
39
24
33
33a
25
41
41a
54
58
56
40
44
32
A
38
F
S
22
15
14
17
42
34
30
36
16
28
20

13
26
39
24
33a
25
41
41a
54
58
56
33
32
40
44
38
A
F
17
22
S
42
14
15
16
30
34
36
28
20

13
26
39
24
25
33
33a
41a
41
54
58
56
44
40
A
32
F
38
22
S
14
15
17
16
42
34
36
30
28
20

13
26
39
24
25
33
33a
41a
54
41
58
44
56
40
32
A
F
38
58
14
15
22
5
17
42
34
16
30
36
28
20

13
26
39
24
33a
25
41
41a
54
44
58
56
33
32
A
F
38
22
5
17
42
34
14
15
16
30
36
28
20

MECHANISM FOR CONTROLLING THE FIRING RATE OF AN AUTOMATIC WEAPON

This application is a continuation of application Ser. No. 08/075,334, filed Jun. 11, 1993, now abandoned which in turn is a cont. of 07/752,609, filed as PCT/GB90/01969, Dec. 17, 1990, now abandoned.

This invention relates to a mechanism for controlling the rate of fire of a weapon capable of automatic fire, such as a sub-machine gun.

It is well-known that sub-machine guns have a tendency to 'climb' during automatic fire. As each round is fired, the weapon recoils upwardly and the muzzle tilts to some degree and thereafter returns to the approximate original point of aim. If the rate of fire in fully-automatic firing mode is too high, each successive round will be fired before the muzzle returns on target following the discharge of the preceding round and will therefore be high off target. Each successive round will therefore be aimed higher than its predecessor. The end result is what is known as 'climb'—that is a burst of rounds which start on target and thereafter climb upwards off target. As the rate of fire increases in relation to a specific weapon so will there be a tendency for the rate of 'climb' to increase.

It has been found that a rate of fire in the order of 400 to 600 rounds per minute can be reasonably controlled by a trained user. At least to some extent this controllability is dependent upon the design and weight of the sub-machine gun; and also upon the training of the user. Important factors contributing to the rate of fire are the weight of the bolt and the distance the bolt travels.

Previous attempts to reduce the size and weight of sub-machine guns have usually necessitated a reduction in the size and weight of the bolt and a reduction in the distance the bolt is allowed to travel. Consequently, this has resulted in a bolt with a faster action giving weapons having rates of fire beyond the desirable maximum rate of about 600 rounds per minute. These efforts in size reduction have therefore resulted in weapons with varying degrees of climb and hence lack of control.

A number of efforts to control the firing rate of a sub-machine gun have involved increasing the mass of the bolt and/or regulating the movement of the bolt. In the first case the physical size of the weapon is reduced but the actual weight of the bolt is increased by use of 'dense material' such as alloys of tungsten, or infilling the bolt with lead. This method is self-defeating in that the overall weight of the gun is increased. Moreover, even the use of the densest materials available gives only a minimal firing rate reduction. Reducing a firing rate from 1,800 RPM to 1,500 RPM falls well short of a reduction to a controllable 400–600 RPM. Regulating the movement of the bolt by 'lock-up' or inertia activated mechanisms have involved utilizing the force generated by a discharging cartridge and have the disadvantage of disabling automatic firing of the gun if the mechanism fails, and also have in practice not removed the rate sufficiently to eliminate climb.

The mechanism of the present invention can be incorporated in a sub-machine gun to give a weapon of hand-gun size which has a controllable rate of fire in the range of between 400 to 600 RPM. Furthermore, the rate of fire is not predetermined by the inherent physical properties of e.g. bolt weight or bolt travel distance. The rate of fire is controlled by means incorporated within the gun but independent of the force generated by a discharging cartridge and is determined by test to suit each weapon in which a mechanism according to the invention is incorporated. Therefore, if a specific model of sub-machine gun firing in fully automatic firing mode returns to its point of aim after each successive round is fired, say in one-tenth of a second, then that particular gun will be adjusted to fire ten times per second or 600 RPM. If another gun has, say, a longer barrel or lighter frame, or has any other feature which changes the firing characteristics of that gun, then that weapon's rate of fire will be adjusted to a rate determined as best suited for achieving its maximum accuracy of fire.

The present invention relates to a trigger mechanism which comprises a timing device wherein the disadvantages of the prior art are overcome or at least mitigated. The invention accordingly provides a trigger mechanism for a gun capable of fully automatic firing comprising a timing device operable to determine the rate of fire of the gun, which device cyclically interrupts means for discharging the ammunition to be discharged from the gun when a physically displacable trigger of the mechanism is moved to a firing position.

According to a feature of this aspect of the invention, said ammunition discharging means may comprise a reciprocal bolt, said bolt being periodically arrested to reduce its natural cyclic rate of movement during automatic firing. Preferably, the device is an electrically powered timing device which actuates a main sear lever for controlling movement of the bolt.

According to a feature of the invention, the timing device may be actuated by the trigger of the trigger mechanism of the gun. In constructions where the timing device is trigger actuated, the trigger mechanism may comprise a trigger operatively connected to a pair of sears each of which sears has a sear face for co-operation with a an arm, said arm being carried by means for actuating a main sear lever for controlling movement of the bolt. Preferably, said pair of sears both co-operate with said arm when the gun is set for semi-automatic firing, said arm being released from the sear face of one sear when the trigger is retracted to release the bolt from a cocked disposition and being arrested by engagement with the sear face of the other sear after discharge of the gun but whilst the trigger remains retracted thereby to arrest movement of the bolt, said arm thereafter being transferred into engagement with the sear face of said one sear when the trigger is released to put the gun once again into a cocked condition.

One sear may actuate the timing device and maintain the device operative during automatic firing of the gun, and the device may regulate movement of the said other sear to cause a reduction in the natural cyclic rate of movement of the bolt. Preferably, the timing device incorporates a rotatable cam for cyclic engagement with a cam follower carried by said other sear to regulate movement of that sear.

The bolt and the main sear may have co-operating cam surfaces which are engaged when the bolt is retracted, the main sear being pivotally mounted to release and arrest said bolt and being controlled by a lever which carries said arm.

Preferably, a firing mode selector switch is brought into co-operation with said one sear to actuate said device during fully automatic firing of the gun and is taken out of co-operation with said one sear to deactivate aid device during semi-automatic firing of the gun.

Another aspect of the invention provides a gun incorporating a trigger mechanism which comprises a timing device as defined in any of the eight immediately preceding paragraphs.

It is important to emphasise that a gun incorporating a trigger mechanism according to the present invention does not mean that the gun is an electrically fired weapon. The firing rate of the gun is controllable by electrical or electronic means in preferable embodiments but should such means fail to function then the gun is nevertheless fully operable in semi-automatic or fully automatic firing mode but, in such a case, at the weapons natural cyclic rate of fire.

An embodiment of the invention will now be described, by way of example, with reference to the accompanying drawings, in which.

Figure 1:
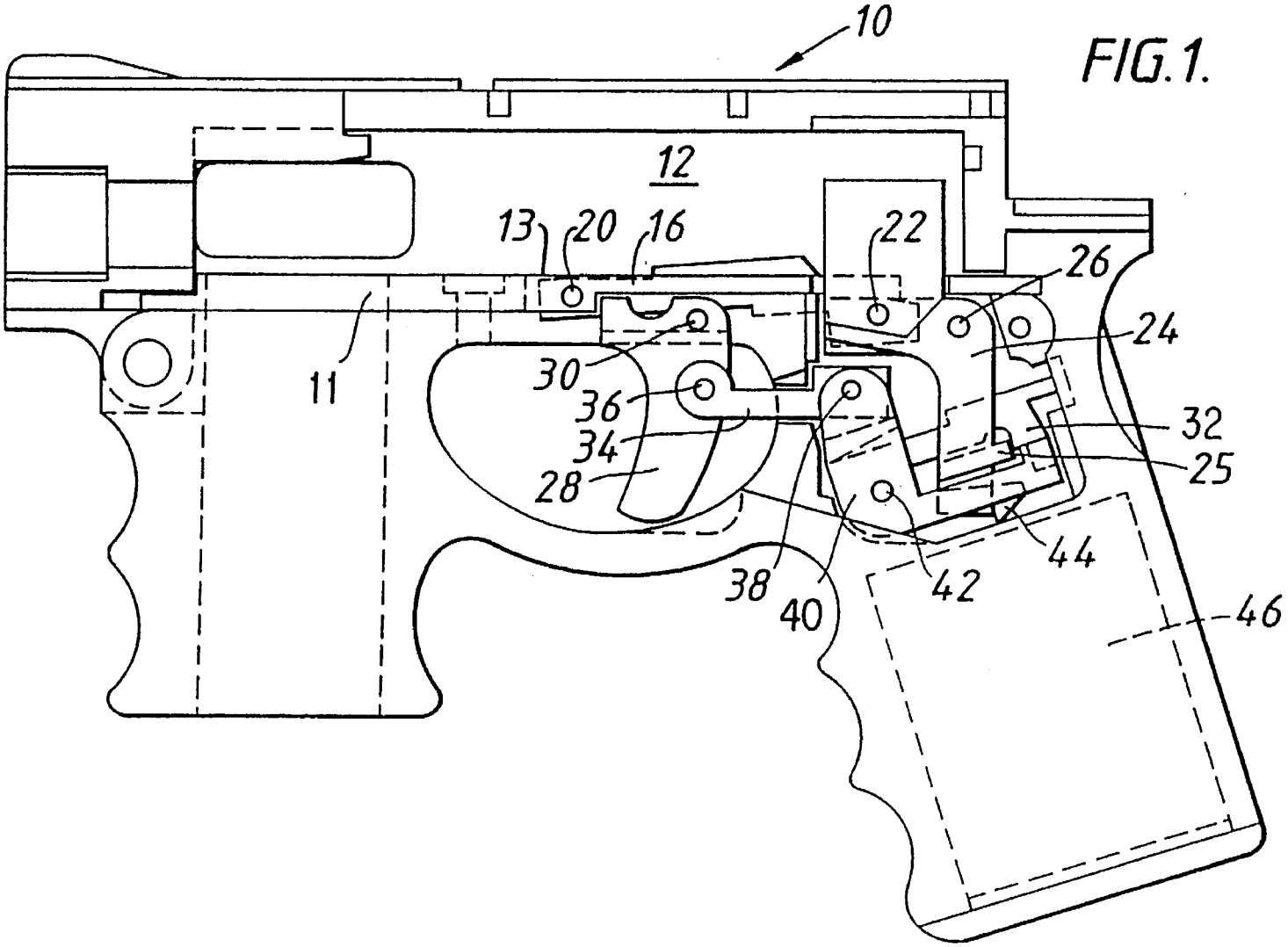
FIG. 1 is a schematic side view partly shown in section, of a sub-machine gun incorporating a trigger mechanism and timing device according to the invention.

Referring first to FIG. 1 of the drawings, a sub-machine gun 10 has a breech 12 in which a bolt 14 (FIGS. 2 to 7) is reciprocable and slideable on a wear plate surface of the breech which, in FIGS. 2 to 7, is shown represented is a horizontal line 13.

Movement of the bolt indirectly is controlled by a main bolt sear lever 16 pivotally mounted at a leading end thereof to the frame '11' of the gun at pivot 20 disposed below the wear plate surface 13. At its opposite trailing end lever 16 is pivotally mounted at pivot 22 to a further lever 24 which carries an arm 25 for co-operation with a pair of let-off sears described in more detail below. Lever 24 is pivotally mounted to frame '11' intermediate its upper and lower ends at pivot 26. A trigger 28 is pivoted to the gun frame at pivot 30, and is operatively connected to a lower sear 40 of the pair of let-off sears by connecting link 34. Link 34 has one of its ends pivotally connected to trigger 28 at pivot 36 and has its opposite end hinged to the lower sear 40 at pivot 38. An upper sear 32 which co-operates with lower sear 40 to control movement of the arm 25 is pivotally mounted together with the lower sear to the frame at pivot 42. The upper sear carries a cam follower 44 which co-operates with an actuating cam of a timing unit 46 disposed in the butt of the gun.

In FIGS. 2 to 7 of the drawings, the large arrows indicate in each case the direction in which a component of the trigger mechanism or firing rate control device is urged to move either by spring force or, in the case of the latter, by electrical propulsive force or other actuating means.

Figure 2:
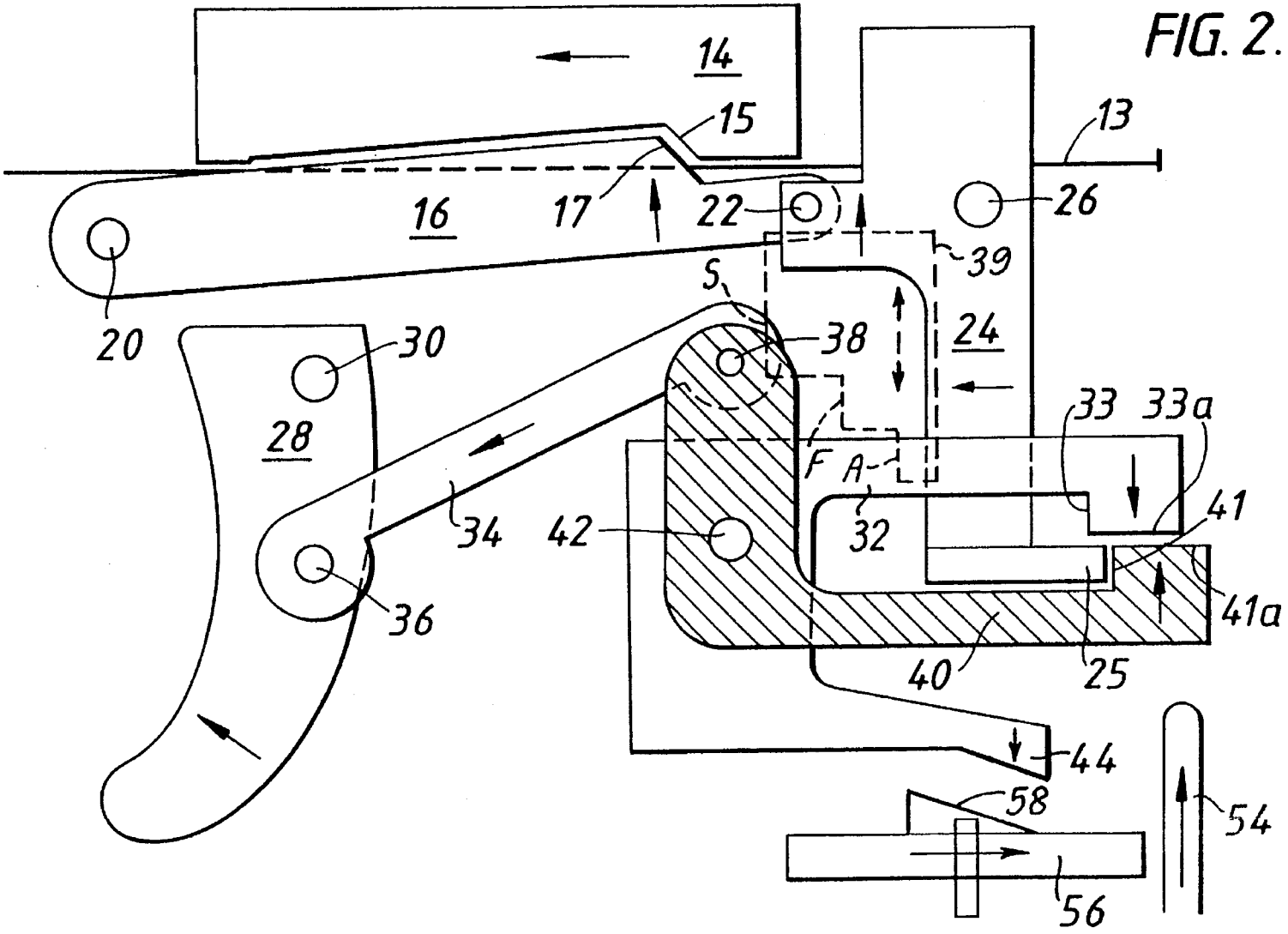
FIGS. 2 to 7 are enlarged schematic and operationally sequential views of the trigger mechanism and timing device.

Referring to FIG. 2, the mechanism is shown in a condition in which the gun is cocked and ready to fire. In this condition, the bolt 14 is held retracted by the main sear lever 16. The main sear lever 16 cannot however, on its own, retain the bolt 14 in a retracted position because the sear face 17 and bolt face 15 of the bolt each provide cooperating 45 degree cam surfaces and because the main spring force indicated by the arrow on bolt 14 is greater than the main sear return spring force, shown by the arrow on lever 16, bolt 14 is urged forwards so that bolt face 15 is forced into abutment with the sear face 17 of sear lever 16. However, because the lever 16 is directly linked to lever 24, if arm 25 of lever 24 is locked against either the sear face 33 of sear 32 or sear face 41 of sear 40, the main sear lever 16 cannot move, and therefore retains the bolt 14 in its retracted position. In FIG. 2, arm 25 is shown held by the lower sear 40 at sear face 41.

As previously stated the trigger 28 is directly linked to the lower sear 40 by link arm 34. As can be seen in FIG. 2, if the trigger is pulled back (retracted to the right in FIG. 2) then the lower sear 40 will be caused to rotate clockwise (downwards) and thereby disengage sear face 41 from arm 25 thereby allowing lever 24 to pivot. Consequently, the bolt is then free to over-ride the main bolt sear lever 16 and move forwards (left in FIG. 2) to discharge the gun. The upper et-off sear 32 has limited movement in a clockwise direction. Upper sear 32 can move only until face 33*a* of sear 32 meets face 41*a* of sear 41. Indeed, sear 32 and sear 40 are biased against each other at faces 33*a* and 41*a* by spring force between those sears in the manner of a common sprung clothes peg as indicated by the Juxtaposed arrows. Pivot pin 38 protrudes axially and acts upon one of three stepped faces S, F and A respectively of a firing mode selector switch 39 shown in FIGS. 2–7 superimposed upon the lever 24 and sear 32. When the firing mode selector switch is in its lowermost position, face 'S' is aligned with the path of movement of pivot pin 38 (FIG. 2) which prevents pivotal movement of lower sear 40. However, when firing, mode selector switch 39 is put into its intermediated position, face 'F' is aligned with the path of movement of pivot pin 38 so that limited pivoting movement of lower sear 40 can take place. Thus, as the lower sear 40 is rotated by retraction of the trigger 28 via link 34, the upper sear 32 will also have a tendency to rotate in the same direction as the lower sear 40. Sear face 33*a* can move away from sear face 41*a* a distance sufficient to follow arm 25 to pass between the faces 33*a* and 41*a*.

It will be seen in FIG. 2 that when the arm 25 is engaged with the lower let-off sear face 41, arm 25 is beneath sear face 33 of the upper sear 32.

Figure 3:
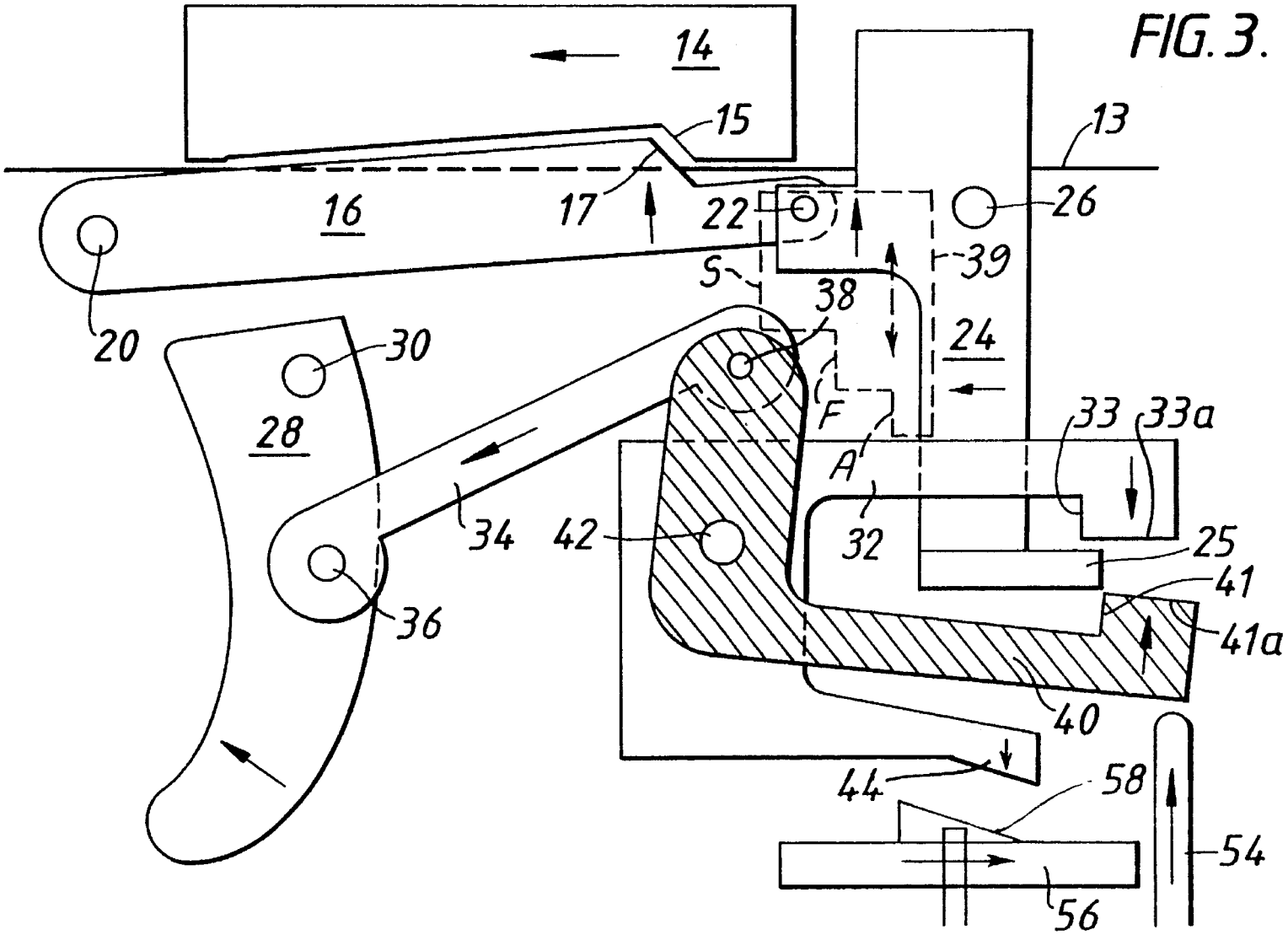

A firing mode selector switch 39 shown in FIG. 3 is set to a semi-automatic firing mode, so that the switch 39 in this firing mode will allow movement of sear 40 until pivot pin 38 abuts face 'F' of firing mode selector switch 39 but will not allow sufficient movement of sear 40 for it to engage timing activator switch 54. Face 'F' stops sear 40 just before it engages switch 54 but just after sear 40 disengages from arm 25.

In FIG. 3, the trigger is shown as having been pulled, thereby causing the sear face 41 of let-off sear 40 to disengage from arm 25 of the lever 24. FIG. 3 shows events at the moment of disengagement. It can also be seen that the upper sear 32 does not move downwards, because it is held back in position by arm 25.

Figure 4:
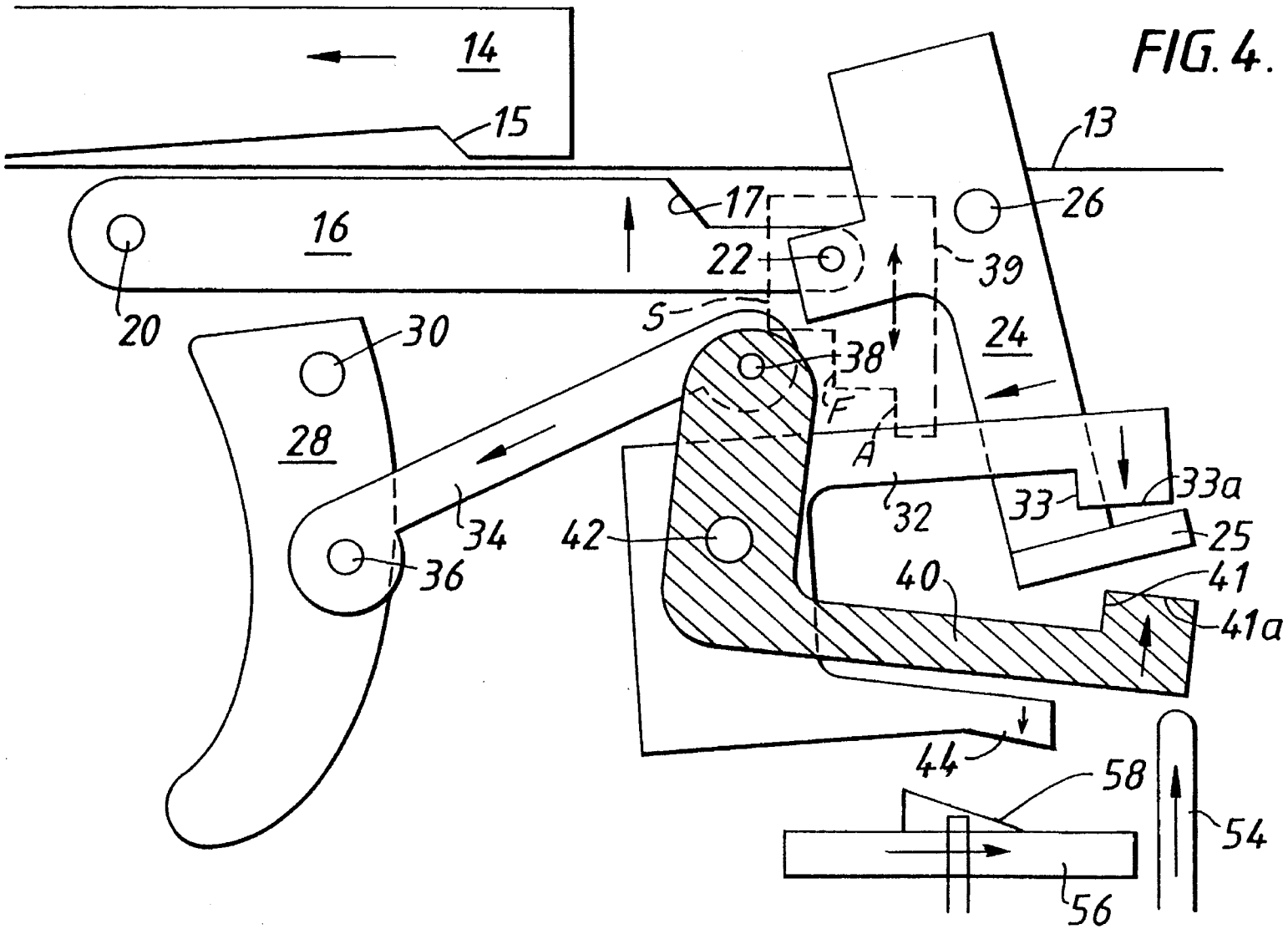

FIG. 4 shows the relative positions of the components of the trigger mechanism immediately after the positions shown in FIG. 3. Lever 24 is no longer retained at arm 25 by let-off sear 32 and consequently bolt 14 is able to over-ride the main reduction sear 16, thereby pushing the main sear lever 16 downward and causing anti-clockwise rotation of lever 24 away from engagement with either let-off sears 32 or 40.

The main sear lever 16 must, of course, move below the surface 13 of the wear plate to release the bolt 14.

Figure 5:
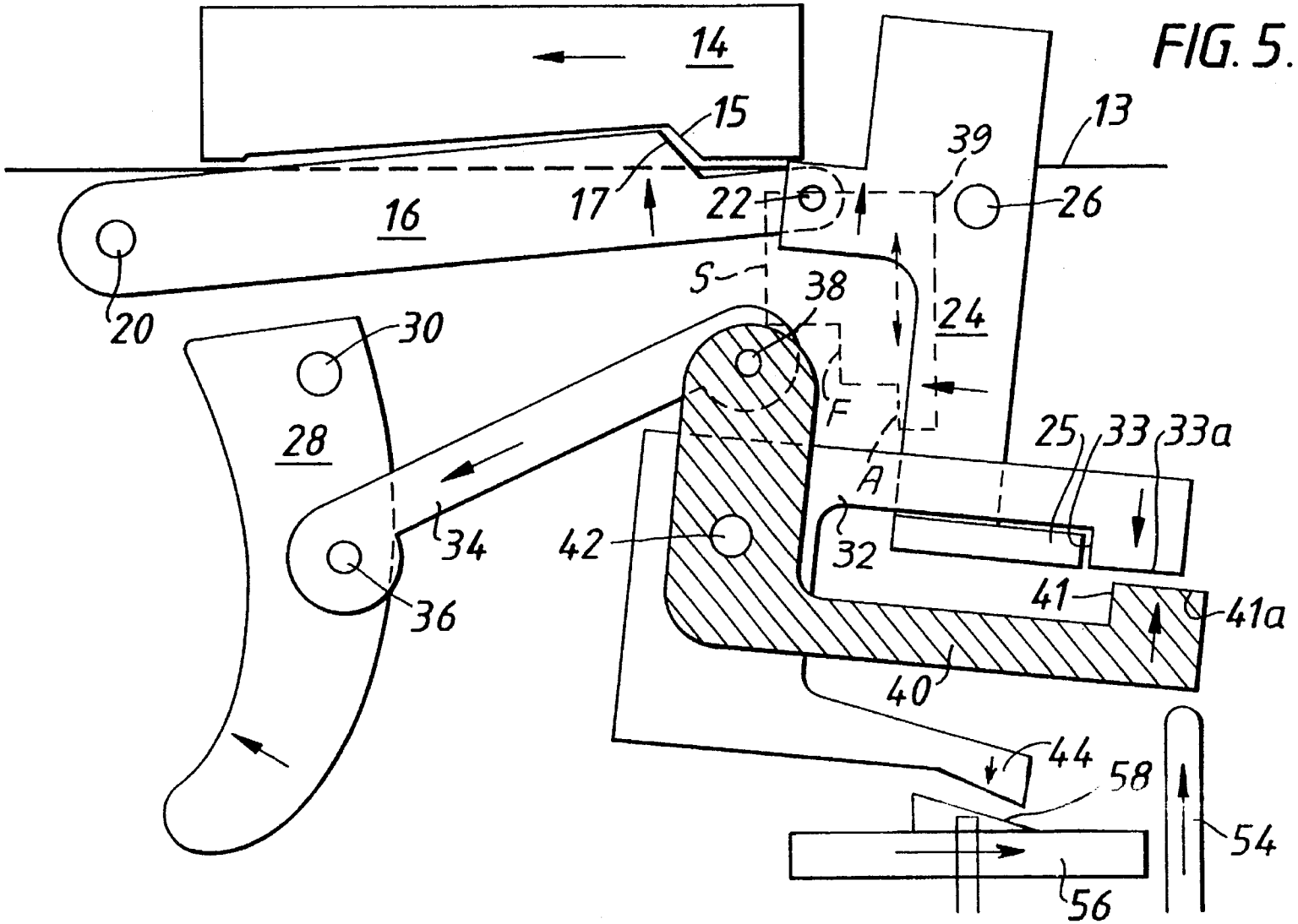

Referring now to FIG. 5, the trigger is shown still in its pulled (retracted) position and the relative positions of the trigger components are shown in positions immediately after those shown in FIG. 4.

The bolt 14 has now discharged a cartridge and has been returned in reaction to discharge of the cartridge along the breech allowing the main sear lever 16 to snap upwards under spring bias into engagement with the bolt at faces 15 and 17 to arrest forward travel of the bolt. As the main sear 16 snaps upwards, it simultaneously causes the lever 24 to rotate clockwise and causes the arm 25 of lever 24 to slide under and beyond the sear face 33 of the upper sear 32. Sear 32 becomes free to re turn to its neutral position against the lower sear 40 in which faces 33*a* and 41*a* are in abutment. In so doing, the upper sear 32 engages the arm 25 at sear face 33 and arrests return movement of lever 24 before the bolt 14 can over-ride cam face engagement at faces 15 and 17. The bolt is thereby locked in a retracted position.

In order for the gun to be fired again in semi-automatic firing mode, the trigger must be released to reset the mechanism. Thus, referring again to Figure 2, as the trigger 28 is released, it causes the lower sear 40 to rotate anti-clockwise (upwards). This action causes the upper sear 32 also to move upwardly because of the engagement between the sears at faces 32*a* and 41*a*. As the upper sear 32 disengages from arm 25 at face 33, face 41 of the lower sear 40 moves into position so that arm 25 is transferred into engagement with face 41 of the lower sear. The weapon is then fully cocked and the trigger is again ready to be pulled.

It will be appreciated that if the upper sear 32 were not present to engage arm 25 after the sear 40 had disengaged, the bolt would be free to continue moving back and forth after an initial round of ammunition had been discharged from the gun. In full unregulated automatic firing mode the weapon would continue to fire until the supply of ammunition was exhausted or until the trigger was released thereby re-engaging the lower sear 40 with the arm 25. In order to fire the gun in regulated fully automatic firing mode, the selector switch 39 is brought into engagement so that the trigger mechanism activates timing mechanism 46 to control movement of the bolt.

Figure 6:
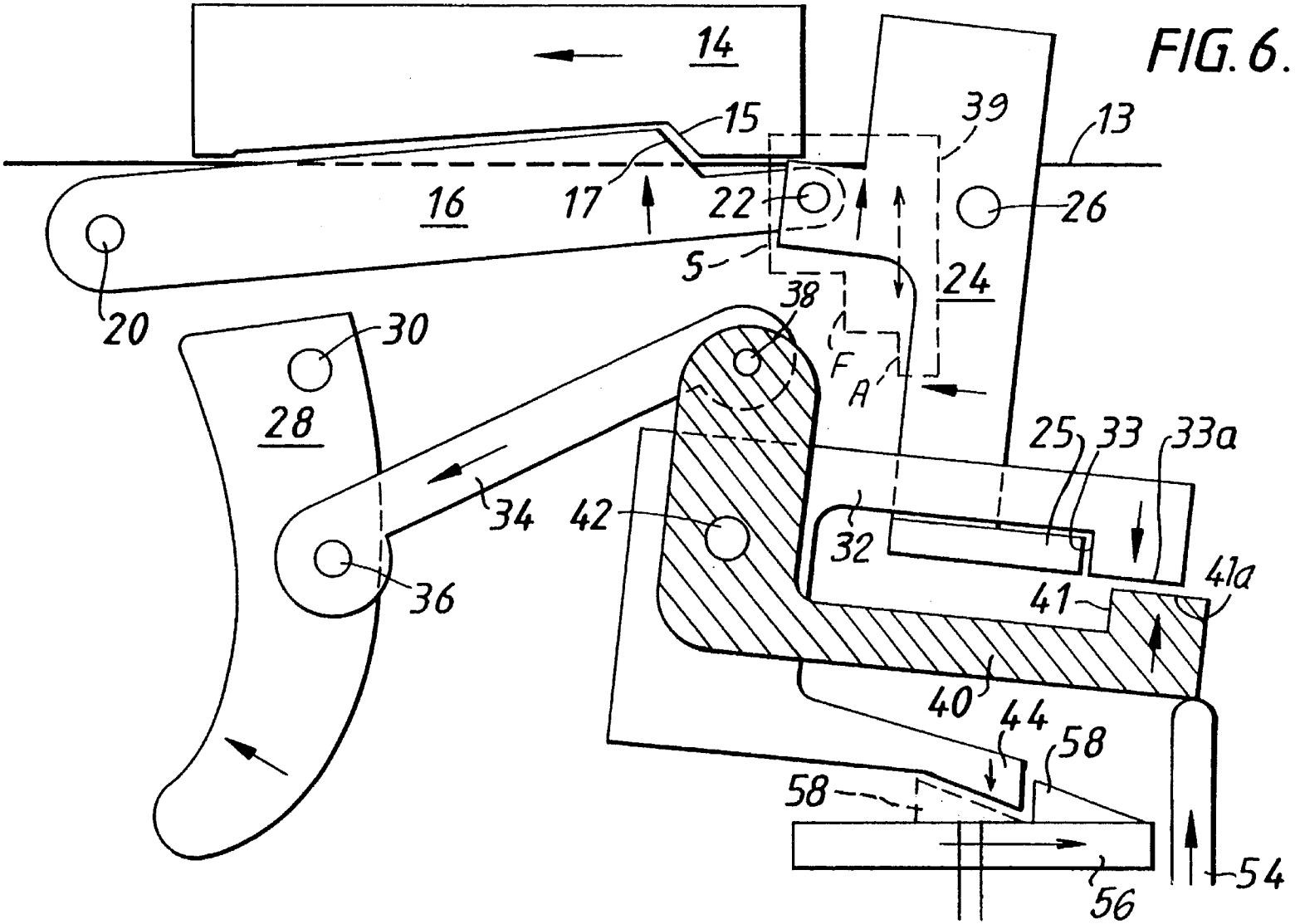

Referring now to FIG. 6, the selector switch 39 is shown in its uppermost position in which face 'A' is aligned with the path of movement of pivot pin 38. When selector switch 39 is in this position lower sear 40 can pivot sufficiently clockwise as to engage and depress timing activator switch 54 when the lower sear 40 is activated via the trigger 28, thus activating the timing unit 46. The timing unit comprises a motor (not shown) which, when active, causes a cam wheel 56 to be rotated in a clockwise direction as seen from above (see FIG. 8).

Other than he intervention of the selector switch 39 the various components of the mechanism are in the relative positions as shown in FIG. 5 for semi-automatic firing. Now, however, after the trigger is retracted and is maintained in pulled back position, and after an initial round of ammunition has been discharged, because the lower sear 40 has been rotated out of engagement with the arm 25, and the upper sear 32 has re-engaged the arm 25, the lower sear 40 serves only to hold switch 54 in a depressed position.

Figure 8:
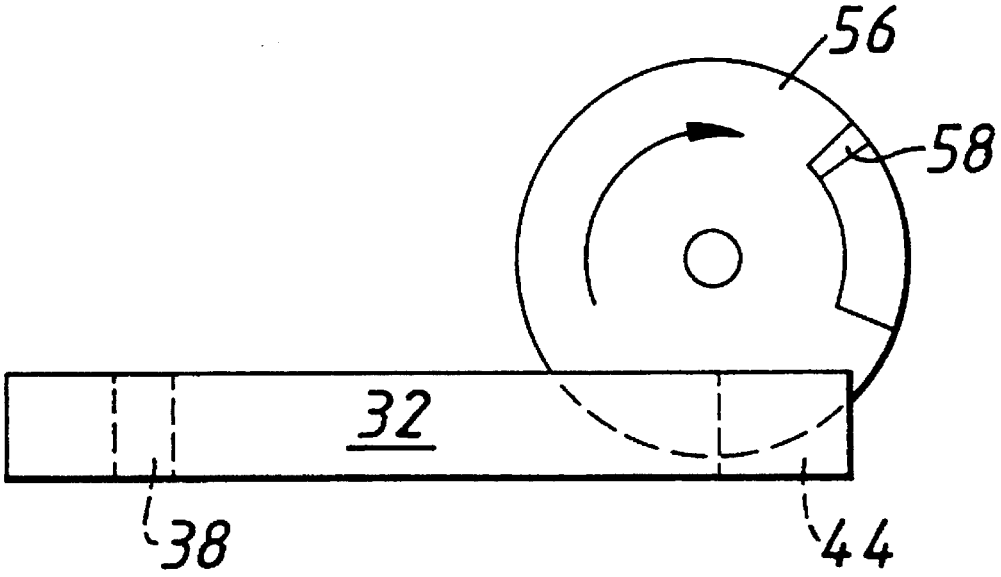
FIG. 8 is a plan view of a cam wheel of the timing device and upper sear lever.

In FIG. 8, the cam wheel 56 is shown in plan view. Once per revolution of the cam wheel, a cam lug 58 carried by the cam wheel will engage cam face 44 of the upper sear 32 and cause the upper sear to rotate anti-clockwise (upwardly) thereby disengaging from arm 25 at sear face 33. Each time the cam 58 causes the upper sear 32 to disengage from arm 25, the gun will be fired and thereafter the upper sear 32 will re-engage arm 25. This will happen only in a cycle in which the period of the cam is less than the natural firing period of the weapon itself. As a safety feature, when the gun is cocked, the cam lug cannot engage the cam face of the upper sear until the trigger is fully retracted. Therefore the movement of the components of the mechanism can be arranged so that the gun can be fired in semi-automatic mode with a less than full trigger pull even with the automatic firing selector switch engaged.

The upper sear 32 must have time to re-engage arm 25. The firing rate can be decreased infinitely by different gear trains or voltage changes etc, but the firing rate cannot be increased beyond the gun's natural un-regulated firing rate.

Figure 7:
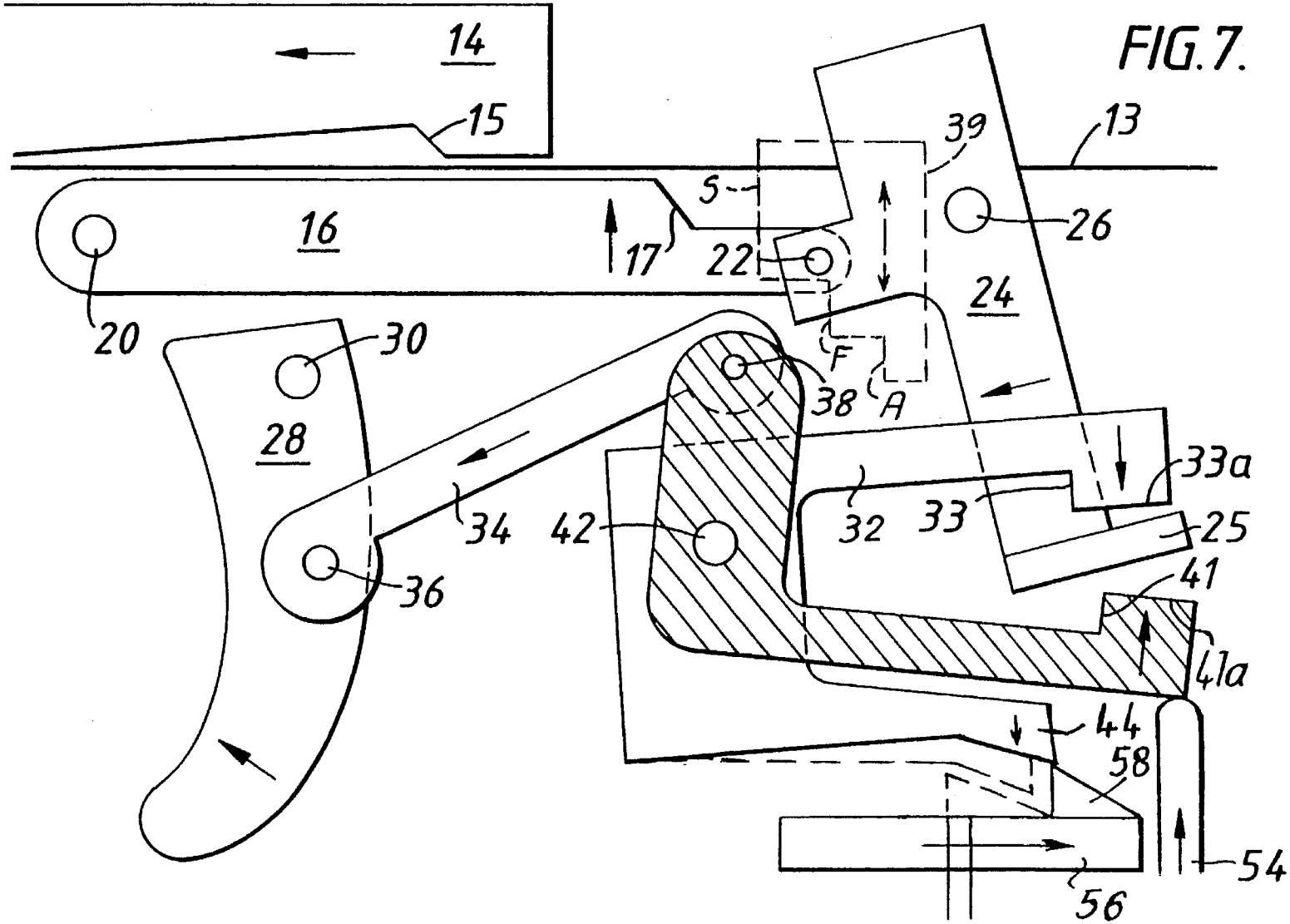

FIG. 6 shows the mechanism in a cocked condition, and FIG. 7 shows the cam 56 positioned to dislodge the upper sear 32 out of engagement with arm 25 of lever 24. This cycle of timed automatic firing will continue until the supply of ammunition is exhausted or until the trigger is released. Upon release, the trigger allows the lower sear 40 to engage arm 25 of lever 24 and allows lower sear 40 to disengage from switch 54, thereby de-activating the timing motor and cam wheel 56. The gun is then ready to be reloaded, if empty, or fired again.

The trigger mechanism is constructed and arranged to reduce the let-off force at arm 25. If face 15 and 17 were perpendicular to the direction of bolt movement as is normal in known weapons, a main spring force of e.g. eighteen pounds would generate a sear let-off force of around six pounds. However, because the faces of the bolt and lever 16 must at a 45 degree angle to the perpendicular an e.g. eighteen pound mainspring force exerts only a nine pound downward force on the main sear lever 16 and therefore that force is transmitted to lever 24 at connecting pivot 22. The arm 25 of lever 24 is twice the distance away from pivot 26 as is pivot 22 so that the force transmitted to arm 25 of lever 24 is one half of that exerted on pivot 22 of lever 24. Therefore, a nine pound force is reduced to a four and a half pound force at bent 25 against sear face 33 or sear face 41. The co-efficient of friction of a four and a half pound force (depending upon the finish of the mating surfaces) of arm 25 and sear faces 33 and 41 can be as low as 0.5. The upper sear 32 is the active let-off sear when the gun s set in regulated fully-automatic firing mode, so notwithstanding the return spring force of sear 32, the actual let-off force the timing unit must overcome with ay be one pound or less.

In both semi-automatic and fully-automatic firing modes, the lower sear 40 holds the bolt in a cocked condition. Since the lower sear 40 is manually controlled via trigger 28, the lower sear can have a much heavier return spring.

It is envisaged that should one require an extremely light trigger pull for semi-automatic firing then, for extra accuracy, a system could be employed which temporarily disengages the heavy trigger return spring (for one shot), and then re-engages after the trigger is released.

The forces holding let-off sears 32 and 40 can be further reduced by substituting the return spring acting on the main bolt sear 16 and the lever 24 with one which exerts a greater force. The above example in which an eighteen pound main spring force transmits a nine pound downward force against pivot pin 22 occurs only if there is no spring force acting on sear 16 to urge it upwardly. If the return spring acting upwardly on sear 16 has a force of e.g., four pounds, then the actual force transmitted downwardly onto sear 16 and pivot pin 22 is five pounds so that only a two and a half pound force is exerted at arm 25. A main sear return spring force of about nine pounds would negate a nine pound downward force transmitted by the bolt main spring, and the bolt would not then move when the trigger was pulled.

Lever 24 has a portion above pivot pin 26 whose mass is equal to the mass of the lever below the pivot pin 26. Lever 24 is a elongate component positioned perpendicular to the line of motion during recoil. The presence of the position above the pivot pin 26 cancels out any oscillation in lever 24 which could adversely affect the lock-up of arm 25 with let-off sear 32 or 40.

The above embodiment employs a cam wheel to trip the upper sear 32. However, any device which delivers the necessary force and can reliably and repeatedly trip the upper sear 32 with the desired and consistent period, could be utilized. The motion of such a device could be reciprocal as opposed to rotary, such as that produced by a solanoid.

The power source or activating the trip device could be other than electrical, such as mechanical, clockwork or Gas pressure. However the present embodiment has the advantage that the timing unit is a self-contained unit, sealed against the elements. It has a life expectancy of up to and in excess of the life of the gun (i.e. 50,000 rounds) depending upon battery size.

The timing unit may incorporate warning lights to indicate battery condition.

The mechanism of the present invention ideally is adapted for incorporation in an open-bolt 9 mm sub-machine gun although a closed bolt may be utilized simply by the replacement of one bolt type for the other. This feature allows the gun to be used with a closed bolt mainly in semi-automatic firing mode when accuracy is of primary importance but where the option of a fully automatic firing mode is available, perhaps in an emergency, even with a closed bolt.

Should the timing unit fail then the gun normally can be fired as a semi-automatic weapon Alternatively it is envisaged that the gun may be furnished with a selector device (not shown) which engages the upper sear 32 and holds it up out of the path of travel of arm 25. This facility allows the gun to be fired in unregulated fully automatic firing mode.

It is also envisaged that means such as an electric spark may be utilized to discharge the ammunition rather than a mechanical bolt in which case the timing unit is adapted to control the emission of the detonating spark.

I claim:

1. A trigger mechanism for a gun having an ammunition discharge means a main sear lever for controlling movement of the ammunition discharge means, means for actuating the main sear lever, and an arm carded by the means for actuating the main sear lever, and the gun being capable of full), automatic firing, said trigger mechanism comprising a physically displaceable trigger, an arrest means including a cam element and a pair of sears each having a sear face for cooperation with the arm, and a timing device having a complementary cam element, said arrest means operable to interrupt said ammunition discharge means of said gun, wherein said cam element of said arrest means cooperates with said complementary cam element of said timing device, and wherein said timing device comprises an electric motor operable to drive said complementary cam element when said physically displaceable trigger is moved to a firing position to enable fully automatic firing of said gun, said timing device being operable to effect cyclical release of said ammunition discharge means by said arrest means.

2. A trigger mechanism according to claim 1 wherein said pair of sears both cooperate with said arm when the gun is set for semi-automatic firing said arm being released from the sear face of one sear when the trigger is retracted to activate the trigger mechanism and being arrested by engagement with the sear face of the other sear after discharge of the gun but whilst the trigger is in said position to activate the trigger mechanism thereby to arrest movement of the ammunition discharge means said arm thereafter being transferred into engagement with the sear face of said one sear when the trigger is released to again put the gun in a cocked condition.

3. A trigger mechanism according to claim wherein said one sear actuates said timing device and maintains said timing device operative during automatic firing of the gun, said timing device regulating movement of said other sear to cause a reduction in the natural cyclic rate of movement of the ammunition discharge means.

4. A trigger mechanism according to claim 3 wherein said timing device incorporates a rotatable cam for cyclic engagement with a cam follower carried by said other sear to regulate movement of that sear.

5. A trigger mechanism according to claim 1 wherein said ammunition discharge means and said main sear lever have cooperating cam surfaces which are engaged when the ammunition discharge means is in a cocked position, said main sear lever being pivotally mounted to release and arrest said ammunition discharge means and being controlled by a lever which carries said arm.

6. A trigger mechanism according to claim 2 wherein a firing mode selector switch is brought into cooperation with said one sear to actuate said timing device during fully automatic firing of the gun and is taken out of cooperation with said one sear to deactivate said timing device during semi-automatic firing of the gun.

7. A trigger mechanism according to claim 1, wherein the ammunition discharge means comprises a bolt, said bolt and main sear lever having cooperating means which act to prevent movement of the bolt which said arrest means is operative to interrupt said ammunition discharge means.

8. A trigger mechanism according to claim 7 further comprises a first and second biasing means which both act on the main sear lever to bias it towards a cooperating position with the bolt, the force of either one of the biasing means alone being insufficient to enable the .main sear lever to interrupt the movement of the bolt during fully automatic firing of the gun.

9. A timing device for controlling in a fully automatic firing mode, the rate of fire of a gun having a trigger means, said timing device comprises an electric motor having a drive shaft, a power supply and a cam means including a cam wheel connected to said drive shaft and having a cam lug, said cam wheel having a first and a second substantially circular face wherein said cam lug protrudes axially from the first face and said drive shaft is connected to the second face, wherein said power supply is a battery unit sealed within the gun and is operable to energize said electric motor which operably rotates the cam means at a constant speed, said timing device being contained inside said gun when in use wherein said cam means is operable to cooperate with the trigger means to effect cyclical discharge of ammunition from said gun when said gun is in a fully automatic mode of firing.

10. A timing device according to claim 9 further comprising an activator switch which is operable to effect rotation of said cam means when said trigger means is engaged to effect fully automatic firing of said gun.

11. A timing device according to claim 10 wherein said activator switch comprises a depressible lever.

12. The timing device of claim 11, wherein said activator switch is mounted to said gun, said trigger means includes a trigger and movable linkage means attached to said trigger for moving into and out of engagement with said activator switch upon the depression of the trigger.

13. A hand-held sub-machine gun comprising a trigger means, and a timing device for controlling in a fully automatic firing mode, the rate of fire of said hand-held sub-machine gun, said timing device includes an electric motor having a drive shaft, a power supply and a cam means including a cam wheel connected to said drive shaft and having a cam lug, said cam wheel having a first and a second substantially circular face wherein said cam lug protrudes axially from the first face and said drive shaft is connected to the second face, wherein said power supply is operable to energize said electric motor which operably rotates the cam means at a constant speed, said timing device being contained inside said hand-held sub-machine gun when in use wherein said cam means is operable to cooperate with the trigger means to effect cyclical discharge of ammunition from said hand-held sub-machine gun when said hand-held sub-machine gun is in a fully automatic mode of firing.

14. The hand-held sub-machine gun of claim 13, wherein said power supply is a battery unit sealed within the hand-held sub-machine gun.

15. The hand-held sub-machine gun of claim 13, further comprising an activator switch mounted to said hand-held sub-machine gun, said trigger means includes a trigger and movable linkage means attached to said trigger for moving into and out of engagement with said activator switch upon the depression of the trigger, wherein said activator switch is operable to effect rotation of said cam means when said trigger is depressed to effect fully automatic firing of said hand-held sub-machine gun.

* * * * *

UNITED STATES PATENT AND TRADEMARK OFFICE

CERTIFICATE OF CORRECTION

PATENT NO. : 5,485,776

DATED : January 23, 1996

INVENTOR(S) : George Ealovega

It is certified that error appears in the above-indentified patent and that said Letters Patent is hereby corrected as shown below:

Column 2, line 34, delete "a" Column 2, line 62, "aid" should read --said--; Column 4, line 9, "et-off" should read --let-off--; and Column 6, line 28, "s" should read --is--.

Column 7, line 34, "carded" should be replaced by --carried--; and at Column 7, line 36, "full)," should be replaced by --fully--.

Signed and Sealed this

Sixteenth Day of April, 1996

Bruce Lehman

BRUCE LEHMAN

*Commissioner of Patents and Trademarks*

*Attest:*

*Attesting Officer*